US007281499B2

(12) United States Patent
Franke et al.

(10) Patent No.: US 7,281,499 B2
(45) Date of Patent: Oct. 16, 2007

(54) METHOD FOR STARTING A STEAM GENERATOR COMPRISING A HEATING GAS CHANNEL THAT CAN BE TRAVERSED IN AN APPROXIMATELY HORIZONTAL HEATING GAS DIRECTION AND A STEAM GENERATOR

(75) Inventors: Joachim Franke, Altdorf (DE); Rudolf Kral, Stulln (DE)

(73) Assignee: Siemens Aktiengesellschaft, Munich (DE)

( * ) Notice: Subject to any disclaimer, the term of this patent is extended or adjusted under 35 U.S.C. 154(b) by 415 days.

(21) Appl. No.: 10/488,328

(22) PCT Filed: Aug. 20, 2002

(86) PCT No.: PCT/EP02/09312

§ 371 (c)(1),
(2), (4) Date: Nov. 1, 2004

(87) PCT Pub. No.: WO03/021148

PCT Pub. Date: Mar. 13, 2003

(65) Prior Publication Data

US 2006/0192023 A1 Aug. 31, 2006

(30) Foreign Application Priority Data

Aug. 31, 2001 (EP) ..... 01121027

(51) Int. Cl.
*F22B 7/00* (2006.01)

(52) U.S. Cl. ..... 122/406.5; 122/406.4; 122/409

(58) Field of Classification Search ..... 122/414, 122/415, 406.4, 409, 448.3, 448.4, 461, 469, 122/479.4, 479.7, 7 R, 406.5; 60/783; 110/101 C, 110/101 CB See application file for complete search history.

(56) References Cited

U.S. PATENT DOCUMENTS 3,576,180 A * 4/1971 Michel ..... 122/406.5
4,685,426 A * 8/1987 Kidaloski et al. ..... 122/214
5,056,468 A * 10/1991 Wittchow et al. ..... 122/451 S
5,588,400 A 12/1996 Stefan et al.
5,983,639 A 11/1999 Kral et al.
6,189,491 B1 2/2001 Wittchow et al.

(Continued)

FOREIGN PATENT DOCUMENTS

DE 1 094 268 12/1960

OTHER PUBLICATIONS

Thomas C. Elliott, "Level Monitoring", Power I & C Special Section , 862 Power, Sep. 1990, No. 9, New York, US, pp. 41-49.

*Primary Examiner*—Gregory Wilson

(57) ABSTRACT

The invention relates to a steam generator comprising a heating gas channel, which can be traversed in an approximately horizontal heating gas direction and in which at least one continuous heating surface is located, configured from a number of approximately vertical evaporator tubes, connected in parallel to allow the passage of a flow medium. The aim of the invention is to provide a method for starting a generator, which guarantees a high degree of operational safety, even for a steam generator with a particularly simple construction. According to the invention, to achieve this, at least several evaporator tubes are partially filled to a predeterminable desired level with unevaporated flow medium, prior to the impingement of the heating gas channel by a heating gas.

7 Claims, 1 Drawing Sheet

U.S. PATENT DOCUMENTS 6,192,837 B1 * 2/2001 Wittchow ..... 122/406.4
6,250,258 B1 6/2001 Liebig
6,957,630 B1 * 10/2005 Mastronarde ..... 122/406.4

* cited by examiner

METHOD FOR STARTING A STEAM GENERATOR COMPRISING A HEATING GAS CHANNEL THAT CAN BE TRAVERSED IN AN APPROXIMATELY HORIZONTAL HEATING GAS DIRECTION AND A STEAM GENERATOR

CROSS REFERENCE TO RELATED APPLICATIONS

This application is the US National Stage of International Application No. PCT/EP02/09312, filed Aug. 20, 2002 and claims the benefit thereof. The International Application claims the benefits of European application No. 01121027.5 EP filed Aug. 31, 2001, both of the applications are incorporated by reference herein in their entirety.

FIELD OF INVENTION

The invention relates to a method for starting a steam generator with a heating gas channel that can be traversed in an almost horizontal heating gas direction, in which at least one continuous heating surface is located, configured from a number of approximately vertical evaporator tubes, connected in parallel to allow the passage of a flow medium. It also refers to a steam generator of this kind.

BACKGROUND OF INVENTION

In a gas and steam turbine system, the heat contained in the expanded operating medium or heating gas from the gas turbine is used to generate steam for the steam turbine. The heat transfer takes place in a waste-heat steam generator downstream of the gas turbine, in which usually a number of heating surfaces are arranged for water preheating, steam generation and steam superheating. The heating surfaces are connected to the water-steam circuit of the steam turbine. The water-steam circuit normally contains several, e.g. three, pressure stages, each having an evaporator heating surface.

Several alternative design concepts are possible for the steam generator connected downstream of the heating gas end of the gas turbine as a waste-heat steam generator, i.e. as a once-through steam generator or as a circulating-steam generator. With a once-through steam generator, the heating of the steam generating tubes provided as evaporator tubes causes evaporation of the flow medium in the steam generator tubes in a single passage. In contrast to this, with a natural- or forced-circulation steam generator the circulated water is only partially evaporated during one passage through the evaporator tubes. The water not evaporated is re-supplied to the same evaporator tubes for further evaporation after removal of the generated steam.

A once-through steam generator is, in contrast to a natural- or forced-circulation steam generator, not subject to pressure limitation and therefore live steam pressures far above the critical pressure of water of ($P_{Kri}$≈221 bar) where there are still only slight differences in density between the liquid-similar and steam-similar medium, are possible. A high live steam pressure favors a high thermal efficiency and therefore low $CO_2$ emissions in a power station heated by fossil fuel. In addition, a once-through steam generator is of simpler construction than a circulating-steam generator and therefore can be manufactured at particularly low cost. The use of a steam generator designed on the once-through principle as a waste heat steam generator of a gas and steam turbine system is therefore particularly suitable for achieving a high overall efficiency of the gas and steam turbine system combined with simple construction.

Particular advantages with regard to the cost of manufacture and also the necessary maintenance work is offered by a waste-heat steam generator of horizontal design where the heating medium or heating gas, in particular the waste gas from the gas turbine, is passed through the steam generator in an almost horizontal direction of flow. A horizontal steam generator of this kind is known from EP 0 944 801 B 1. Because of its design as a once-through steam generator, the overflowing of water from the evaporator tubes forming the continuous heating surface into the downstream superheater must be prevented during operation. However, this can cause problems, particularly when starting the steam generator.

When the steam generator is started, a water discharge, as it is called, can occur. This arises when the flow medium in the evaporator tubes initially evaporates due to the heating of the evaporator tubes and this, for example, takes place in the middle of the particular evaporator tube. This causes the quantity of water downstream (also known as water plugs) to be expelled from the particular evaporator tube. To reliably make sure that unevaporated flow medium from the evaporator tubes cannot reach the superheater connected after the tubes, the known steam generator, such as normally also a once-through steam generator of vertical design, is provided with a water-steam separator or precipitator connected between the evaporator tubes forming the continuous heating surface and the superheater. Surplus water is drawn off from this and either returned to the evaporator by a circulating pump or discharged. A water-steam separating system of this kind is, however, comparatively expensive with regard to both design and maintenance.

SUMMARY OF INVENTION

The object of the invention is therefore to provide a method for starting a steam generator of the type stated above, that also guarantees a high degree of operating safety combined with a particularly simple construction. Furthermore, a steam generator particular suitable for the performance of the method is also to be specified.

With regard to the method, this object is achieved according to the invention in that at least several of the evaporator tubes forming the continuous heating surface are partially filled to a predeterminable desired level with unevaporated flow medium before heating gas is applied to the heating gas channel.

The invention is based on the consideration that to maintain a high operational safety when the steam generator is starting, the entry of unevaporated flow medium into the superheater connected after the evaporator tubes must be safely prevented. For a particularly simple construction, however, this should be ensured without the water-steam separating device normally provided with once-through steam generators. To achieve this, with a steam generator of horizontal construction where an outlet connector connected to the outlet end of the evaporator tubes forming the continuous heating surface is directly connected to an inlet distributor of the superheater, only partial filling of the evaporator tubes with unevaporated flow medium should take place before starting. The amount, and therefore the desired level, for this initial filling prior to the impingement of the heating gas channel by a heating gas should be chosen so that on the one hand the water discharge due to the initial steam formation is avoided and on the other hand inadequate cooling of the evaporator tubes during starting is precluded.

The desired level is appropriate chosen so that at the beginning of the starting operation the supply of the evaporator tubes with flow medium can be omitted. Thus, during the starting process, i.e. after the heating gas channel has been impinged by the heating gas, evaporation of the flow medium already present in the evaporator tubes first takes place. In this process the unevaporated flow medium, within the particular evaporator tube downstream of the particular location of the start of evaporation, is shifted by the forming steam bubble into the zone of the particular evaporator tube that previously was unfilled. There, this amount of the unevaporated flow medium can evaporate or, if sufficiently low mass flow densities are maintained in the evaporator tubes, again drops into the lower space of the particular evaporator tube. By choosing a suitable desired level, the part area of the particular evaporator tube located in the upper area of the particular evaporator tube, initially not filled with flow medium and serving as a compensating space for the column underneath as a flow medium, can thus be designed to be large enough to securely prevent the outflow of unevaporated flow medium from the particular evaporator tube, even at the start of evaporation.

During the partial filling of the particular evaporator tubes before the initial impingement of the heating channel by heating gas, the actual level of the particular evaporator tubes is advantageously matched to the predeterminable desired level. To do this, the actual full level is advantageously determined by measuring the pressure difference between the lower tube inlet and upper tube outlet of the particular evaporator tube, with the value obtained in this way being appropriately used as a basis for the supply of the particular evaporator tube with unevaporated flow medium.

Depending on the operating state of the steam generator and its previous history, different time characteristics of the heating of the steam generator during its starting phase can be provided. To guarantee a particularly reliable maintenance of the boundary conditions even when the pattern of the starting phase varies that both reliably precludes the outflow of unevaporated flow medium from the evaporator tubes and in each case guarantees adequate cooling of all evaporator tubes, the desired level for the initial filling of the evaporator tubes is advantageously determined on the basis of the design heating characteristics on starting. The characteristics of the heating on starting are determined appropriately using characteristic values for the boiler geometry and/or time characteristics of the heat supply by the heating gas. For this purpose, characteristics of heating on starting matched to a number of parameter combinations of this kind can be stored in a database assigned to the steam generator, with it being possible in particular to take account of the heating cycles preceding the current heating cycle.

In the starting phase of the starting process, i.e. in a time span immediately after the start of impingement of the heating gas channel with heating gas, operation of the steam generator is provided without further impingement of the evaporator tubes by flow medium or feed water. However, it is appropriate for the supply of feed water or unevaporated flow medium to the evaporator tubes to take place after the onset of steam formation in the evaporator tubes, so that after steam formation has occurred an adequate cooling of the particular evaporator tube is ensured in each case. The onset of steam formation in this case is advantageously detected by a pressure rise in the water-steam circuit. To enable the evaporator tubes to be supplied with feed water to meet demand in a particularly reliable manner, a measured value characteristic of the pressure of the flow medium is thus advantageously monitored after the start of impingement of the heating gas channel by heating gas, whereby if this measured value then exceeds a predetermined limit, a continuous impingement of the evaporator tubes by feed water takes place.

After the start of supply of the feed water to the evaporator tubes, the feed water supply to the evaporator tubes is controlled so that an outflow of unevaporated flow medium from the evaporator tubes is securely avoided. To do this, the supply of feed water to the evaporator tubes is advantageously controlled in such a way that superheated steam emerges from the upper tube outlet of that or every evaporator tube. To guarantee that no evaporated flow medium can reach the downstream superheater, the provision at the outlet of the evaporator tubes of steam that is comparatively only weakly superheated is sufficient.

To guarantee a particularly high operating stability of the steam generator, the mass flow density of the flow medium being fed to the evaporator tubes is set in such a way that an evaporator tube heated more than a different evaporator tube with the same continuous heating surface has a higher throughput of flow medium than the other evaporator tube. The continuous heating surface of the steam generator thus, with regard to the flow characteristics of a natural circulation evaporator heater (natural circulation characteristics), has, if different heating patterns of individual evaporator tubes occur, a stabilizing behavior that leads to a matching of the outlet temperature, without the need of an external influence even with differently heated evaporator tubes connected in parallel at the flow medium end. To guarantee this characteristic, an impingement of the evaporator tubes by a comparatively low mass flow density is provided.

This object is achieved with regard to the steam generator in that a common differential pressure measuring device is allocated to a distributor connected to the inlet of the evaporator tubes and to an outlet collector connected to the outlet of the evaporator tubes. The differential pressure measuring device enables the level in the evaporator tubes to be monitored in a particularly satisfactory manner, so that a characteristic value for this can be used as a suitable guide value for the supply of the evaporator tubes.

The particular advantages of the invention are that just by a partial filling of the evaporator tubes with the unevaporated flow medium before an initial impingement of the heating gas channel by heating gas a starting process with high operating safety is guaranteed, thus, particularly with adequate cooling of the evaporator tubes, the admittance of unevaporated flow medium to the superheater downstream of the evaporator is securely avoided, therefore enabling a particularly simple construction of the steam generator. In this case the comparatively expensive water-steam separating system can be completely done away with whilst maintaining the high operating safety standard, without the need to use particularly robust or high-quality raw materials in the construction in its place. A particularly secure and stable operating behavior is thus especially achievable in that the evaporator tubes are impinged at comparatively low mass flow density, so that unevaporated flow medium in the evaporator tubes also remains in the particular evaporator tube even at the onset of steam formation in the particular evaporator tube and is finally also evaporated there.

BRIEF DESCRIPTION OF THE DRAWING

An example of the embodiment of the invention is further explained with the aid of a drawing. The drawing is a simplified representation showing a longitudinal section of a steam generator of horizontal construction.

DETAILED DESCRIPTION OF INVENTION

Figure 1:
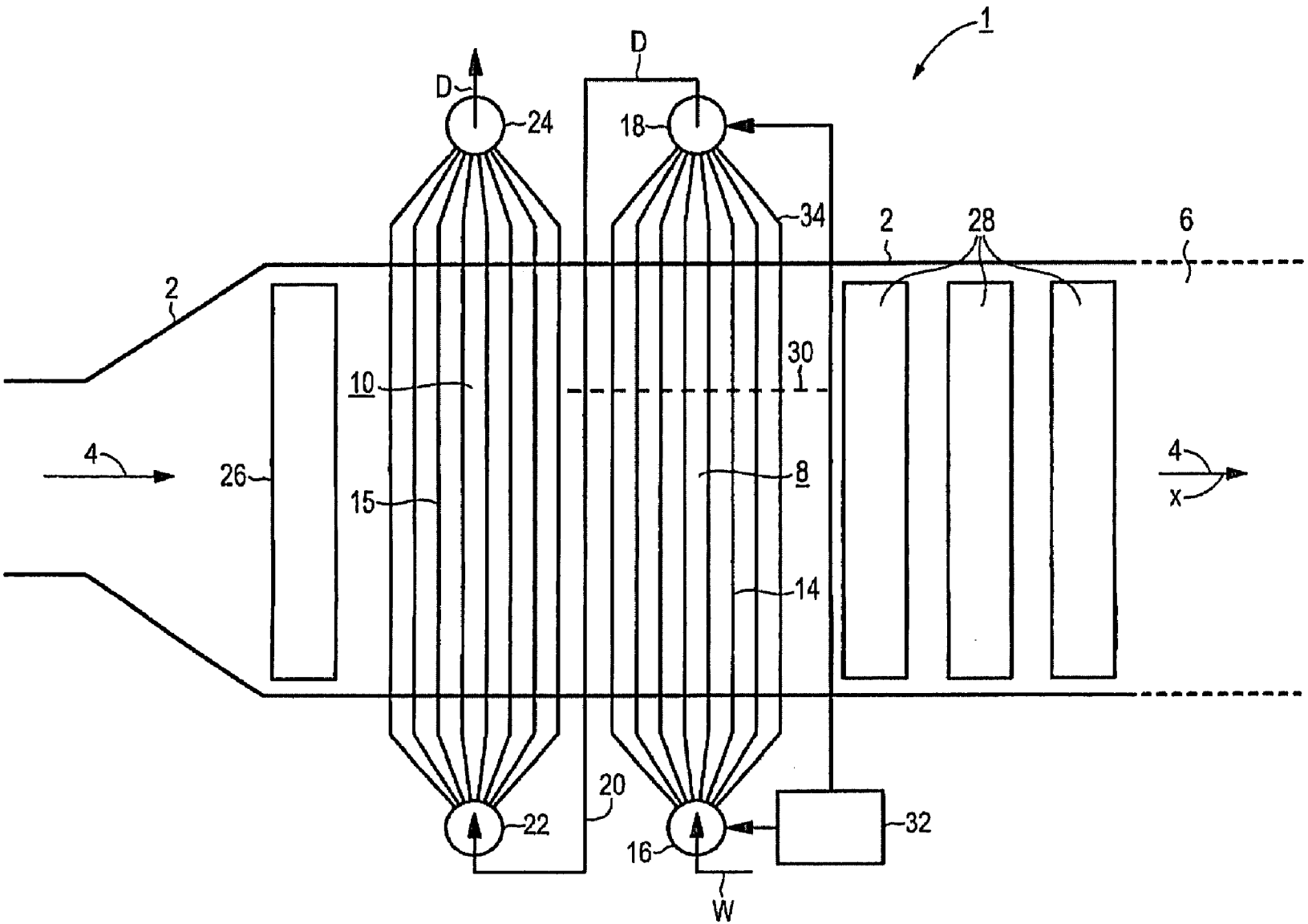

The steam generator 1 in accordance with the illustration is connected to the outlet gas end of a gas turbine (not illustrated in more detail) as a waste-heat steam generator. The steam generator 1 has a surrounding wall 2 that forms an almost horizontal heating gas channel 6 for the exhaust gas from the gas turbine, that can be traversed in the heating gas direction x shown by the arrow 4. The heating gas channel 6 contains a number of evaporator heating surfaces designed according to the continuous principle, also designated a continuous heating surface 8, 10. The exemplary embodiment shows two continuous heating surfaces 8, 10, but also just one or a greater number of continuous heating surfaces can be provided.

The continuous heating surfaces 8, 10 of the steam generator 1 each consist of a number of parallel evaporator tubes 14 or 15 in the form of a tube bundle to allow the passage of a flow medium W. The evaporator tubes 14, 15 are in this case each aligned almost vertically, with a number of evaporator tubes 14 or 15 being arranged side-by-side viewed in the heating gas direction x. In each case, only one of the evaporator tubes 14 or 15 arranged side-by-side in this way is visible.

A common distributor 16 is connected before the evaporator tubes 14 of the first continuous heating surface 8 at the flow medium end and a common outlet collector 18 is connected to the outlet end. The outlet of the outlet collector 18 of the first continuous heating surface 8 is connected via a drop pipe system 20 to a distributor 22 allocated to the second continuous heating surface 10. The outlet of the second continuous heating surface 10 is connected to an outlet collector 24.

The evaporator system formed by the continuous heating surfaces 8, 10 can be impinged by the flow medium W that is evaporated by a single passage through the evaporator system and is drawn off from the outlet of the evaporator system as steam D and fed to a superheater surface 26 connected to the outlet collector 24 of the second continuous heating surface 10. The pipe system formed by the continuous heating surfaces 8, 10 and the superheater surface 26 connected after them is connected to the water-steam circuit of a gas turbine (not illustrated in more detail). In addition, a number of other heating surfaces 28, in each case schematically indicated, are connected to the water-steam circuit of the gas turbine. The heating surfaces 28 can, for example, be medium-pressure evaporators, low-pressure evaporators and/or preheaters.

The evaporator system formed by the continuous surfaces 8, 10 is designed in such a way as to be suitable for a supply of the evaporator tubes 14, 15 at a comparatively low mass flow density, with the evaporator tubes 14, 15 having a natural circulation characteristic. With this natural circulation characteristic, an evaporator tube 14 or 15 heated more than a different evaporator tube 14 or 15 with the same continuous heating surface 8 or 10 has a higher throughput of flow medium W than the other evaporator tube 14 or 15.

The illustrated steam generator 1 is of comparably simple construction, In this case, the main difference is that the second continuous heating surface 10 is connected directly to the superheating surface 26 connected after it, omitting a comparatively expensive water-steam separating system or precipitation system, so that the outlet collector 24 of the second continuous heating surface 10 is directly connected via an overflow line, and without other components connected in between, to a distributor of the superheating surface 26. However, to also maintain a comparatively high operating safety with this comparatively simple design in all operating states, the steam generator 1 is operated within these boundary conditions when starting. In this case, the steam generator 1 is particularly operated on starting in such a way that on the one hand there is sufficient cooling of the evaporator tubes 14, 15 forming the continuous heating surfaces 8, 10 and also of the steam generator tubes forming the superheating surface 26. On the other hand, the steam generator 1 is also operated in such a way on startup that also without a water-steam separating system connected between the second continuous heating surface 10 and the superheating surface 26, the supply of unevaporated flow medium W to the superheating surface 26 is securely avoided.

To guarantee this, the evaporator tubes 14 forming the first continuous heating surface 8 are filled to a predeterminable desired level, shown by the dotted line 30 in the illustration, with unevaporated flow medium W, before the initial impingement of the heating gas channel 6 with heating gas from the upstream gas turbine. The filling of the evaporator tubes 14 with unevaporated flow medium W before the commencement of heating in this case takes place through the feed water line and the distributor 16 that are present in any case. In this way, the actual level achieved in the evaporator tubes 14 is determined by measuring the pressure difference between the lower distributor 16 and the upper outlet collector 18. For this purpose, a common differential pressure measuring device 32 is allocated to the distribution 16 and outlet collector 18. Using the actual level in each evaporator tube 14, determined in this way, further filling with unevaporated flow medium W is controlled so that the predetermined desired level is obtained within a predetermined tolerance band.

On completion of the initial filling of the evaporator tubes 14 with unevaporated flow medium W, further supply of the flow medium W to the evaporator tubes 14 is halted. In this condition, the beginning of the actual starting process for the steam generator 1 takes place, with, in particular, the impingement of the heating gas channel 6 with heating gas from the upstream gas turbine taking place. Due to the heating of the evaporator tubes 14 that has now begun, the unevaporated flow medium W in the evaporator tubes begins to evaporate. A local evaporation then takes place in each of the evaporator tubes 14 after a certain time period, with the still unevaporated flow medium W downstream or above the actual location of the start of evaporation being shifted to the upper zone of the particular evaporator tube 14 initially not filled with flow medium W. There, an evaporation of this part of the flow medium W takes place, or this part of the flow medium W drops back into its lower area due to the comparatively low design mass flow density in the evaporator tubes 14.

Any unevaporated flow medium W still remaining is passed through the drop pipe system 20 into the next downstream second continuous heating surface 10 and there it is completely evaporated. The second continuous heating surface 10 thus takes the still remaining water discharge from the first continuous heating surface 8 in each case. Because the evaporator tubes 14 are only partly filled before the start of the actual starting process, no, or practically no, unevaporated flow medium W enters the outlet collector 24 connected after the second continuous heating surface 10 or the superheater surface 26 connected after the outlet collector.

The exemplary embodiment thus provides for only partial filling of the evaporator tubes 14 forming the first continuous heating surface 8; the second continuous heating surface 10 initially remains unfilled. Additionally, in an alternative form of embodiment, evaporator tubes 15 forming the second continuous heating surface 10 can also be partially filled using a similar method.

A determination of whether steam production has already started in the evaporator tubes 14 and evaporator flow medium or steam D has entered the outlet collector 24 is determined by measuring the pressure of the flow medium W or steam D, particularly at the outlet collector 24 or the outlet of the superheating surface 26. A measured value characteristic of the pressure of the evaporated flow medium or steam D in the outlet collector 24 or at the outlet of the superheating surface is detected and monitored by means of a suitable arranged pressure sensor. This enables the start of steam production to be inferred on the basis of an increase in pressure, which can reach several bars per minute when steam begins to form.

After the onset of steam formation in the evaporator tubes 14 has been detected in this way, the operating supply of feed water or unevaporated flow medium W to the distributor 16 allocated to the continuous heating surface 8 takes place. During the further starting process, i.e. particularly until a steady-state operating condition is reached, the supply of feed water or unevaporated flow medium W to the evaporator tubes 14 is controlled in such a way that superheated steam D, i.e. steam D without a wet component, emerges at the upper tube outlet 34 of the evaporator tubes 14.

Moreover, the mass flow density of the flow medium W being supplied to the evaporator tubes 14 is set so that an evaporator tube 14 heated more than a different evaporator tube 14 has a higher throughput of flow medium W than the other evaporator tube 14. This ensures that the continuous heating surface 8 has a self stabilizing behavior in the manner of the flow characteristics of a natural-circulation evaporator heating surface even if different heating of individual evaporator tubes 14 occurs.

The performance, shown here, of the starting process of the steam generator 1 ensures adequate cooling for the evaporator tubes 14, 15 at all times and also that no unevaporated flow medium W enters the superheating surface 26 connected after the second continuous heating surface 10 at any time. Compliance with these boundary conditions in this case is to be particularly ensured by the choice of the desired level for the evaporator tubes 14 before beginning the actual starting process. The desired level for the evaporator tube 14 is predetermined so that precisely these boundary conditions are complied with as a basis for the design starting process. To do this, the desired level is preset for steam generator 1 depending on the design heating characteristics on starting. The heating characteristics on starting in this case are determined from characteristic values for the boiler geometry and material and/or the type of fuel. In particular, it can be provided in this case that a number of possible starting heating characteristics suitable for the steam generator 1 in question are stored in a memory module as a type of database, from which a characteristic matched to the actual situation can be selected using operating data and used as a basis for specifying the desired level.

The invention claimed is:

1. A method for starting a steam generator, comprising:

traversing a heating gas channel with a heating gas in an approximately horizontal heating gas direction;

locating at least one continuous heating surface, configured from a number of approximately vertical evaporator tubes connected in parallel to allow the passage of a flow medium;

partially filling at least several evaporator tubes to a predeterminable desired level with an unevaporated flow medium; and impinging the heating gas channel by the heating gas, wherein during a supply of the evaporator tubes with the flow medium, a particular mass flow density is set so that an evaporator tube heated more than a different evaporator tube of the same continuous heating surface has a higher throughput of flow medium than the different evaporator tube.

2. The method in accordance with claim 1, wherein the level of the unevaporated flow medium in the particular evaporator tubes is determined by a differential pressure measurement between the lower tube inlet and upper tube outlet.

3. The method in accordance with claim 2, wherein the desired level is specified relative to design starting heating characteristics.

4. The method in accordance with claim 3, wherein the starting heating characteristics are determined on the basis of characteristic values for the boiler geometry and/or the time characteristics of the heat supply by the heating gas.

5. The method in accordance with claim 4, wherein a measured value characteristic of a pressure of the flow medium is measured when the heating gas channel is impinged by heating gas, whereby if the measured value exceeds a predeterminable limit, a continuous impingement of the evaporator tubes by unevaporated flow medium takes place.

6. The method in accordance with claim 5, wherein the supply of flow medium to the evaporator tubes takes place after the onset of steam formation in the evaporator tubes.

7. The method in accordance with claim 6, wherein the supply of flow medium to the evaporator tubes is controlled in such a way that superheated steam emerges at the upper tube outlet of the one or every evaporator tube.

* * * * *